US005592765A

United States Patent [19]

Oomen et al.

[11] Patent Number: 5,592,765

[45] Date of Patent: Jan. 14, 1997

[54] IRON HAVING AN ANTI-FRICTION LAYER

[75] Inventors: Emmanuel W. J. L. Oomen, Eindhoven; Hans De Beurs, Drachten, both of Netherlands

[73] Assignee: U.S. Philips Corporation, New York, N.Y.

[21] Appl. No.: 294,287

[22] Filed: Aug. 23, 1994

[30] Foreign Application Priority Data

Aug. 23, 1994 [BE] Belgium ..... 09300858

[51] Int. Cl.[6] ..... D06F 75/38

[52] U.S. Cl. ..... 38/93

[58] Field of Search ..... 38/93, 74, 81, 38/77, 78; 106/1.17; 428/315.9; 219/245, 228, 229; 100/92, 93 P; 118/300, 320, 323; 427/446, 450–456, 430.1, 421, 427

[56] References Cited

U.S. PATENT DOCUMENTS

| | | | |
|---|---|---|---|
| 4,154,617 | 5/1979 | Keithler | 106/1.17 |
| 4,665,637 | 5/1987 | Kramer | 38/93 |
| 4,738,896 | 4/1988 | Stevens | 428/315.9 |
| 4,800,661 | 1/1989 | Yamamoto et al. | 38/93 |
| 4,822,686 | 4/1989 | Louison et al. | 38/93 X |
| 4,862,609 | 9/1989 | Ullrich et al. | 38/93 |

FOREIGN PATENT DOCUMENTS

| | | | |
|---|---|---|---|
| 0227111 | 7/1987 | European Pat. Off. . | |
| 2151858 | 5/1972 | Germany . | |
| 3617034 | 4/1987 | Germany . | |
| 150799 | 8/1985 | Japan | 38/93 |
| 956740 | 7/1962 | United Kingdom . | |

*Primary Examiner*—Ismael Izaguirre
*Attorney, Agent, or Firm*—Ernestine C. Bartlett

[57] ABSTRACT

The invention relates to an iron comprising a metal soleplate which is provided with an anti-friction layer of an inorganic polymer, preferably of polysilicate, which is provided by a sol-gel process. Such anti-friction layers exhibit a high hardness, a high corrosion resistance and a satisfactory resistance against rapid temperature variations. The anti-friction layer preferably also comprises fluoridized hydrocarbon compounds. By virtue of these compounds the anti-friction layer has a higher coefficient of friction which is comparable to that of teflon. The anti-friction layer can be provided in various ways. Preferably, it is provided by spraying.

13 Claims, 1 Drawing Sheet

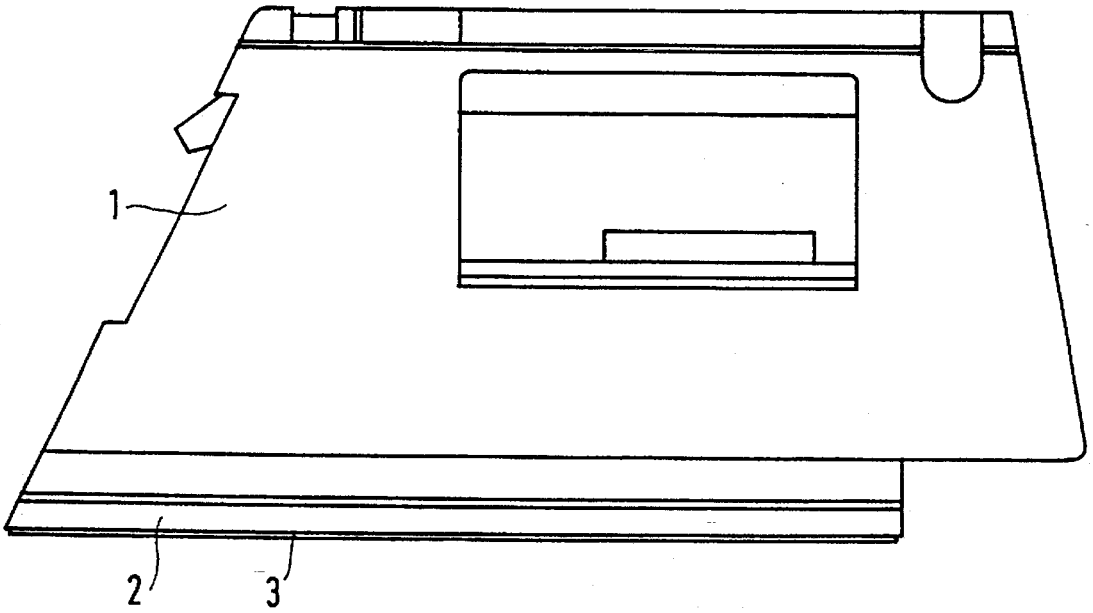
1
2
3

IRON HAVING AN ANTI-FRICTION LAYER

BACKGROUND OF THE INVENTION

The invention relates to an iron comprising a metal soleplate which is provided with an anti-friction layer. The invention also relates to a method of providing an anti-friction layer on a metal soleplate.

An iron of the type mentioned in the opening paragraph is known per se. For example, in German Patent Specification DE 36.17.034, a description is given of an iron whose soleplate is provided with an anti-friction layer which is composed of at least two sub-layers. The first sub-layer consists of a base layer of, for example, aluminium oxide or a mixture of aluminium oxide and titanium oxide, which is applied to the metal soleplate by, for example, plasma spraying. Said base layer is provided with a second sub-layer of synthetic resin, for example on the basis of Teflon.

The known iron has disadvantages. For example, it has been found that, in particular, the mechanical strength of the anti-friction layer is insufficient. This is caused by, in particular, the relatively low scratch resistance of the synthetic resin layer. It has further been found that the stability of the synthetic resin layer presents problems. The stability of synthetic resins at temperatures of maximally approximately 300° C., which are customary for irons, is generally not optimal. In addition, the provision of a double layer, as described with respect to the known anti-friction layer, is time-consuming and expensive.

SUMMARY OF THE INVENTION

It is an object of the invention to provide an iron in which the above disadvantages have been overcome. The invention more particularly aims at providing an iron comprising a metal soleplate whose anti-friction layer has a high scratch resistance. It should be possible to provide said anti-friction layer on the soleplate in a simple and inexpensive manner. In addition, the anti-friction layer should be resistant to corrosion and to frequent and rapid temperature variations up to maximally 300° C. The invention further aims at providing a method of applying an anti-friction layer to a soleplate.

These and other objects are achieved by an iron of the type mentioned in the opening paragraph, which is characterized in accordance with the invention in that the anti-friction layer comprises an inorganic polymer, preferably of polysilicate, which is provided by means of a sol-gel process.

A layer which is provided by means of a sol-gel process has a very good scratch resistance as compared to the synthetic resin sold under the trademark TEFLON. As will be described in greater detail hereinbelow, such a layer can be provided on a metal soleplate in a simple manner. It has been found that an anti-friction layer in the form of an inorganic polymer exhibits a very high resistance against corrosion and against frequent and rapid temperature variations in the range from 20°–300° C. Such an inorganic polymer may be based on poly-Zr-oxide, poly-Ti-oxide or poly-Al-oxide. However, to save costs, use is preferably made of an inorganic polymer on the basis of polysilicate. Sols on the basis of polysilicates can be manufactured in a simpler manner and remain stable for a longer period of time than the other above-mentioned sols.

BRIEF DESCRIPTION OF THE DRAWING

The sole figure of the drawing is a cross-sectional view of the invention.

DETAILED DESCRIPTION OF THE INVENTION

A preferred embodiment of the iron in accordance with the invention is characterized in that the anti-friction layer also comprises fluoridized hydrocarbon compounds. By virtue of the presence of such compounds the iron has a noticeably lower frictional resistance during ironing. Consequently, this measure leads to considerably improved ironing properties of the iron in accordance with the invention. The fluoridized hydrocarbons may be embedded as loose compounds in the inorganic polymer matrix of the anti-friction layer, for example in the form of a fine-grain powder of Teflon. However, said fluoridized hydrocarbon compounds are preferably covalently bonded to the inorganic polymer.

The invention also relates to a method of providing an anti-friction layer on a metal soleplate. In accordance with the invention, this method is characterized in that a layer of a sol-gel solution is provided on the soleplate, and at a higher temperature an inorganic polymer is formed from said sol-gel solution.

The preparation of a sol-gel solution is known per se. If a sol-gel solution is used for the manufacture of layers on a substrate, first a colloidal suspension of solid particles in a liquid is prepared. In the present case, preferably hydrolysed metal alkoxide particles in an organic solvent are used. In this connection, known metal alkoxides are Ti-, Zr-, Al- and Si-alkoxide. Usually an alcohol is used as the organic solvent. A small quantity of water as well as a small quantity of an acid or base as the catalyst are added to the said colloidal solution or sol which is then provided in a thin layer on a desired substrate. The catalyst and the water added bring about hydrolysis of the alkoxides, whereafter polycondensation into an inorganic polymer can make place at an increased temperature, and the solvents are evaporated from the sol-gel layer obtained.

By means of the sol-gel process very thin layers of inorganic polymer can be provided on the soleplate. For example, thicknesses below 1 micrometer, and even below 0.5 micrometer, can be obtained by using this technique. The use of these thin layers and the choice of an alkoxy silicate as the monomer for the inorganic polymer ensure that the inventive anti-friction layers are very cheap.

A favourable embodiment of the method in accordance with the invention is characterized in that the solution also comprises 3-glycidyloxypropyltrimethoxysilane (GLYMO), in a quantity of maximally 50 wt. % of the overall quantity of alkoxy silicate. The presence of this compound in the colloidal solution brings about a substantially improved adhesion of the sol-gel anti-friction layer to the metal soleplate. In the absence of this compound the soleplates must be subjected to a number of additional cleaning steps before they are provided with an anti-friction layer of an inorganic polymer. By virtue of the presence of said compound these process steps can be omitted.

Another favourable embodiment of the method in accordance with the invention is characterized in that the solution also comprises a fluoridized silane compound. The presence of said compound results in considerably improved hydrophobic properties of the anti-friction layer. A quantity of 0.1 wt. % of the overall quantity of colloidal particles suffices to provide the inorganic polymer formed with hydrophobic properties which are comparable to those of TEFLON. Quantities in excess of 5 wt. % do not result in a further improvement of the hydrophobic properties of the anti-friction layer.

There are various ways of providing the colloidal solution on the soleplate in the form of a layer, for example by immersing or spin coating. In accordance with a very advantageous embodiment of the method in accordance with the invention, the layer is provided by means of spraying techniques. Layers provided in this manner have a lower coefficient of friction than layers provided by spin coating. It has been found that owing to the adjustability of the size of the droplets during spraying and of the temperature of the soleplate the coefficient of friction of the anti-friction layer can be varied. The droplets sprayed onto the soleplate provide the anti-friction layer with a bumpy structure. An anti-friction layer having a bumpy structure has better ironing properties than a smooth anti-friction layer.

The invention will be explained in greater detail by means of exemplary embodiments and the drawing, in which FIG. 1 shows an iron in accordance with the invention.

FIG. 1 shows a steam iron. Said iron comprises a synthetic resin housing 1 whose bottom side is provided with a metal soleplate 2. In this case, the soleplate is made of a stainless steel alloy. The surface of the soleplate facing away from the housing is provided with an anti-friction layer 3. This layer comprises an inorganic polymer on the basis of polysilicate which is provided by means of a sol-gel process. Hereinbelow, a description will be given of a number of inventive methods of providing the anti-friction layer of an inorganic polymer on the soleplate.

In accordance with a first embodiment of the method according to the invention, a sol-gel solution comprising 10 g TEOS (tetraethyl orthosilicate), 80 g ethanol, 10 g acidified water (1 N HCl) was prepared. After hydrolysing for one hour, the solution was spinned onto the ironing surface of a stainless steel soleplate at a rate of 600 r.p.m. The soleplate had previously been cleaned by subjecting it to, in succession, an ultrasonic treatment in a soap-containing solution and an UV/ozone treatment. The sol-gel layer provided by spin coating was cured at 300° C. for 30 minutes. The polysilicate anti-friction layer formed (thickness 200 nm) exhibited a satisfactory scratch resistance and a satisfactory adhesion to the metal soleplate. Deterioration of the adhesion after the soleplate had been exposed 500 times to a temperature cycle from 20°–300° C. did not take place.

In accordance with a second embodiment of the method according to the invention, the above-mentioned sol-gel solution was provided on the cleaned soleplate by means of a spraying robot. A series of experiments showed that the anti-friction layers obtained by means of this method had a lower coefficient of friction than the anti-friction layers obtained by means of immersing or spin coating. The smoothness of the anti-friction layer could be influenced, inter alia, by varying the size of the droplets and the temperature of the soleplate. The increased smoothness of the anti-friction layer has a positive effect on the ironing behaviour of the iron.

In accordance with a third exemplary embodiment of the method in accordance with the invention, a solution comprising 2 g GLYMO, 8 g TEOS, 80 g ethanol and 10 g acidified water (1 N HCl) was hydrolysed for 2 hours. This solution was subsequently spin coated onto a stainless steel (AISI 304) soleplate. The soleplates were cleaned only by means of an ultrasonic treatment in a soap-containing solution. The sol-gel layer provided was cured at 200° C. for 30 minutes. The anti-friction layer of inorganic polymer (thickness 300 nm) thus formed exhibited a satisfactory adhesion to the metal soleplate in spite of the absence of the UV/ozone treatment. The scratch resistance of the layer was excellent.

In accordance with a fourth embodiment of the method according to the invention, a sol-gel solution comprising 10 g TEOS and FTES which were dissolved in 80 g ethanol and 10 g acidified water (1 N HCl) was manufactured. FTES stands for Fluoroalkyltriethylsilane. The length of the fluoroalkyl group can vary, in principle, from 5 to 15 C atoms. In the present case, $C_6F_{13}CH_2CH_2$-Si-$(OC_2H_5)_3$ was used. The solution was provided on a soleplate by means of a spraying robot and subsequently cured at 160° C. The anti-friction layer formed exhibited a satisfactory hardness and was resistant to temperature variations up to 300° C. By virtue of the presence of fluoridized hydrocarbons in the anti-friction layer, the ironing properties of the irons were much better than the ironing properties of the above-described embodiments.

To determine the optimum quantity of the relatively expensive fluoridized alkyl silanes, the molar ratio of TEOS and FTES in the sol-gel solution was varied in a number of experiments. The contact angle of a droplet of water on a layer of inorganic polymer of the examined composition was subsequently determined. The values obtained, which are expressed as a function of the concentration of FTES, are given in the following Table. Said Table shows that a relatively small quantity of approximately 0.1 mol % FTES leads to a substantial improvement of the hydrophobic properties of the anti-friction layer. If more than 5 wt. % FTES is added to TEOS no further improvement of the hydrophobic properties of the anti-friction layer is obtained. In this connection, it is noted that the contact angle of water on teflon is approximately 107°.

| FTES/TEOS | angle (°) |
|---|---|
| 0/100 | 40 ± 4 |
| 0.03/100 | 75 ± 5 |
| 0.1/100 | 101 ± 5 |
| 0.3/100 | 107 ± 5 |
| 0.6/100 | 109 ± 5 |
| 1/100 | 110 ± 5 |
| 4/100 | 102 ± 5 |
| 15/100 | 104 ± 5 |
| 30/100 | 102 ± 5 |

We claim:

1. An iron comprising a metal soleplate which is provided with an anti-friction layer, wherein in the anti-friction layer comprises an inorganic polymer.

2. An iron as claimed in claim 1, characterized in that the anti-friction layer also comprises fluoridized hydrocarbon compounds.

3. An iron comprising a metal soleplate which soleplate is provided with an anti-friction layer, wherein the antifriction layer comprises polysilicate.

4. An iron according to claim 3 wherein the anti-friction layer also comprises fluoridized hydrocarbon compounds.

5. A method of providing an anti-friction layer on a metal soleplate of an iron comprising providing the soleplate with a layer of a solution of a sol-gel convertible into an inorganic polymer by heating and heating said layer to thereby convert the sol-gel into an inorganic polymer.

6. A method according to claim 5 wherein the solution of a sol-gel is sprayed on the soleplate.

7. A method as claimed in claim 5, wherein the sol-gel solution comprises an alkoxy silicate.

8. A method as claimed in claim 7, wherein the solution also comprises 3-glycidyloxypropyltrimethoxysilane, in a quantity of maximally 50 wt. % of the overall quantity of alkoxy silicate.

9. A method as claimed in claim 8 wherein the solution also comprises a fluoridized silane compound.

10. A method according to claim 8 wherein the solution of a sol-gel is sprayed on the soleplate.

11. A method according to claim 7 wherein the solution of a sol-gel is sprayed on the soleplate.

12. A method as claimed in claim 7, wherein the solution also comprises a fluoridized silane compound.

13. A method according to claim 12 wherein the solution of a sole-gel is sprayed on the soleplate.

* * * * *